US011607796B2

(12) United States Patent
Villarino, III

(10) Patent No.: US 11,607,796 B2
(45) Date of Patent: Mar. 21, 2023

(54) STRIKING TOOL

(71) Applicant: Ernest R. Villarino, III, San Diego, CA (US)

(72) Inventor: Ernest R. Villarino, III, San Diego, CA (US)

( * ) Notice: Subject to any disclaimer, the term of this patent is extended or adjusted under 35 U.S.C. 154(b) by 3 days.

(21) Appl. No.: 16/852,775

(22) Filed: Apr. 20, 2020

(65) Prior Publication Data

US 2021/0323138 A1 Oct. 21, 2021

(51) Int. Cl.

| | |
|---|---|
| ***B25G 1/10*** | (2006.01) |
| ***B25D 1/02*** | (2006.01) |
| ***B25D 1/04*** | (2006.01) |
| ***B25B 23/16*** | (2006.01) |
| ***B25B 13/06*** | (2006.01) |

(52) U.S. Cl.

CPC ..... *B25G 1/10* (2013.01); *B25B 13/065* (2013.01); *B25B 23/16* (2013.01); *B25D 1/02* (2013.01); *B25D 1/045* (2013.01); *B25D 2250/015* (2013.01); *B25D 2250/361* (2013.01)

(58) Field of Classification Search

None

See application file for complete search history.

(56) References Cited

U.S. PATENT DOCUMENTS

| | | | | |
|---|---|---|---|---|
| 1,923,964 | A * | 8/1933 | Benton | B25F 1/006 7/145 |
| 6,435,059 | B1 | 8/2002 | Martinez | |
| 6,536,308 | B1 | 3/2003 | Thorne et al. | |
| 6,655,236 | B1 * | 12/2003 | Slack | B25D 1/02 81/20 |
| 6,899,001 | B1 * | 5/2005 | Sanders | B25G 1/04 81/125 |
| 9,718,179 | B1 | 8/2017 | Martinez | |
| 2004/0261188 | A1 * | 12/2004 | Mathis | B25D 1/00 7/145 |
| 2012/0091409 | A1 * | 4/2012 | Hanlon | B25D 1/12 81/22 |
| 2015/0251302 | A1 * | 9/2015 | Flosi | B25D 1/02 81/25 |
| 2019/0084141 | A1 * | 3/2019 | Keast | B67B 7/16 |

FOREIGN PATENT DOCUMENTS

| | | | | |
|---|---|---|---|---|
| KR | 20180063790 | A * | 6/2018 | B25S 1/02 |

OTHER PUBLICATIONS

Translation of KR-20180063790 (Year: 2018).*

* cited by examiner

*Primary Examiner* — Brian D Keller

(74) *Attorney, Agent, or Firm* — Kelly & Kelley, LLP

(57) ABSTRACT

A striking tool includes an elongated handle having a first end and a second end. The head is attached to or formed integrally with the first end of the handle and defines a striking portion, a claw portion, and a body portion therebetween. The striking tool may have slots, notches, and/or cavities configured to engage fasteners or other objects for applying torsion thereto. A striking member may be removably attached to the striking portion of the head, which may define a nail puller. Attachments, such as an axe head, may be removably attachable to the head of the striking tool.

24 Claims, 14 Drawing Sheets

STRIKING TOOL

BACKGROUND OF THE INVENTION

The present invention relates generally to hand-held striking tools, such as hammers and the like, that comprise a handle which is gripped by the user and a head that has at least one striking portion. More particularly, the present invention relates to such striking tools having features which are configured to engage fasteners or other objects for applying torsion thereto and which can have attachments, such as an axe head, attached thereto.

Hand-held striking tools have been in use for a very long time and are available in a wide variety of different configurations which are beneficially constructed and selected to accomplish one or more striking tasks. Such tools comprise a handle having a lower end and an upper end and a head that is either attached to or integral with the handle, typically at or near the upper end thereof. A gripping portion of the handle is sized and configured to be comfortably and safely held in the hand of the user so the user can swing the handle with his or her arm to direct the head of the tool to where the work is to be accomplished. The head of the striking tool is generally structured and arranged to accomplish the desired striking or other work objective. One common configuration for a striking tool is as a hammer with the head comprising at least one striking surface that is selected to contact a work object and achieve the desired work objective, which may be to drive the work object into another object, reshape the object, break the object into smaller pieces or like tasks. Another configuration for a striking tool is as an axe having at least one blade with a sharp edge that is driven against wood to shape or break the wood.

With regard to striking tools that are configured as a hammer, there are a wide variety of different types of hammers. Perhaps the most common type of hammer is the claw hammer, which is utilized by millions of professional and non-professional carpenters and other construction workers throughout the world. The head of the typical claw hammer has a striking portion at one end and a claw portion at the opposite end. The striking portion of the head has an outwardly disposed striking face that is directed at and makes contact with the object, such as the head of a nail or the like, for which the striking tool is being utilized to accomplish a particular work objective, such as driving the nail into a piece of wood. The striking face may be planar or have a slight curvature thereto.

Typically, the head of a striking tool is made out of hardened steel or other very hard metals, usually by a casting or forging process, to provide a striking portion, claw portion, pick portion or other portions which are sufficiently rigid and impact resistant to allow the user provide the necessary force with the striking tool to accomplish the desired work objective. More recently, striking tool heads have also been made out of lighter weight materials, such as titanium and titanium-based alloys, that are sufficiently strong enough to accomplish the desired striking objectives but reduce the weight of the portion of the tool that is swung by the user. In addition to being easier to carry and swing, the use of a lighter weight head increases the speed of the head as it arcs through its swing path to provide a greater amount applied force at the striking face or at the other desired striking portion of the tool. Compared to hardened steels and the like, titanium is a softer material. As a result, the impact force against the striking portion of the head can result in wear and distortion, particularly at or near the striking face.

The claw portion of the hammer typically comprises a pair of outwardly extending, divergently spaced apart claw members that are structured and arranged to be received under the head of a nail in a manner that allows the user of the claw hammer to apply leverage to the nail to pull or pry the nail out from where it was previously placed. The nail puller comprises a pair of nail engagement edges and an opening into the hammer head. The opening is designed such that the head of the nail being pulled will fit inside the opening so the nail engagement edges will engage the underside of the nail head. The user pulls the nail out of the object by laying the hammer head next to the nail head, sliding the nail engagement edges under the nail head and then rotating the hammer head to pull the nail out of the object.

The handle of a typical striking tool, including hammers, is sized and configured for the user to securely, safely and comfortably grip the striking tool and to maintain that grip as he or she swings the tool and contacts the head of the tool against an object. The handle of a hammer can be made out of wood, polymers and a variety of metals, including steel, aluminum, titanium and the like. Depending on the material utilized for the handle, the lower section thereof may be coated, covered, imbedded with or otherwise comprise a gripping material that provides the user with the ability to better grip the handle, swing the tool and absorb the contact with the object being hit.

Despite the various advantages of the prior art with regard to improved configurations for striking tools, there remains a need for further improvements to striking tools. Specifically, with regard to the striking member of the striking tool, there is a need to be able to separately replace the striking member of the striking tool. As well known by persons skilled in the art, often the striking member of the striking tool will prematurely wear or become damaged so it is no longer useable, such as the striking portion becoming misshaped, while the other portion of the tool is still useable. Presently, it is common that the entire striking tool is replaced. Accordingly, there is a continuing need for an improved striking tool. The present invention fulfills these needs, and provides other related advantages.

SUMMARY OF THE INVENTION

The present invention resides in a striking tool comprising an elongated handle having a first end and a second end. A head is attached to or formed integrally with the first end of the handle. The head defines a striking portion, a claw portion generally opposite the striking portion and a body portion therebetween.

The striking tool may comprise an elongated slot formed in the handle having a tapering diameter along a length thereof and defined by opposing walls configured to engage fasteners or other objects of varying sizes for applying torsion thereto.

The striking tool may also comprise an open-ended notch formed at the second end of the handle for engaging a fastener.

The striking tool may include an open-faced cavity formed in the body portion of the head for engaging a fastener or other object. An adjustment mechanism may be associated with the cavity for adjustably engaging fasteners or objects of varying sizes. The adjustment mechanism may comprise a bolt selectively threadedly received through the head and into the cavity.

A striking member may be removably attached to the striking portion of the head. A fastener may extend through a passageway of the head and into an aperture of the striking member. The striking member may comprise a striking face and an apron extending therefrom and defining a beveled inner surface that frictionally engages a surface of the striking portion of the head as the striking member is fastened to the striking portion of the head. The striking member may include a notch formed therein having opposing edges which define a nail puller.

The striking tool may have attachments removably attached thereto. For example, an axe head maybe removably attachable to the head of the striking tool.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention is directed to a striking tool, generally referred to by the reference number 10. The striking tool 10, as will be more fully described below, has many design aspects and features which make it an improvement over conventional hammers and render the striking tool 10 multi-purpose in nature.

Figure 1:
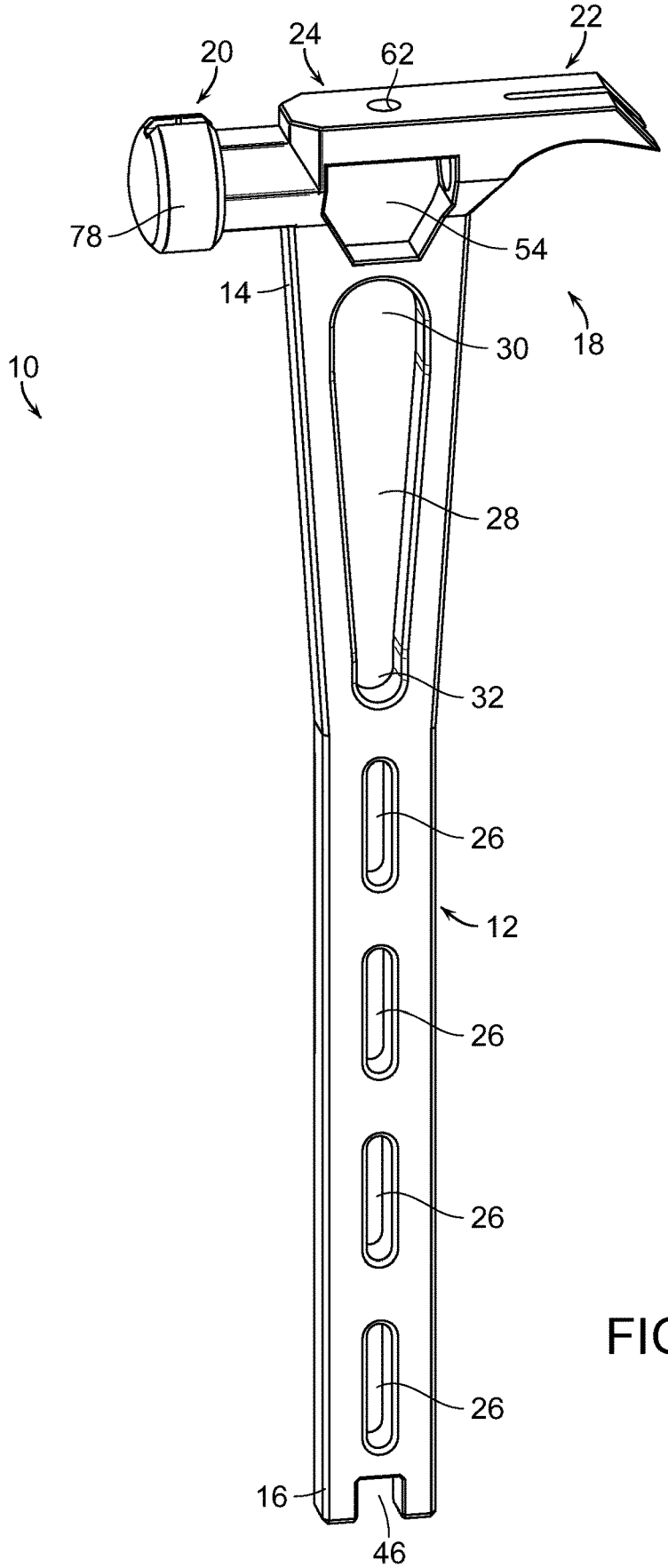
FIG. 1 is a side perspective view of a striking tool embodying the present invention.
Figure 2:
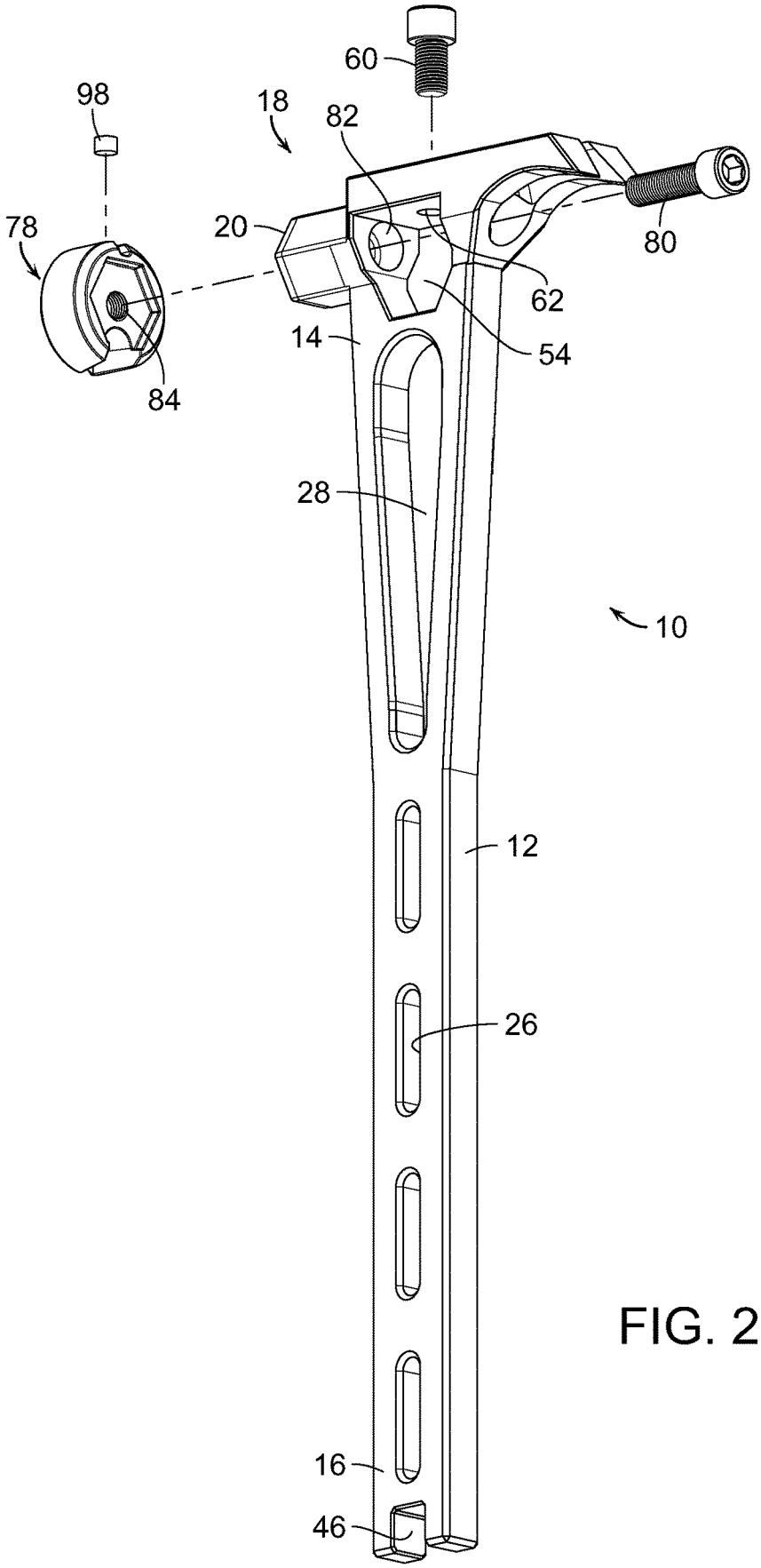
FIG. 2 is an exploded perspective view of component parts of the striking tool of FIG. 1.
Figure 3:
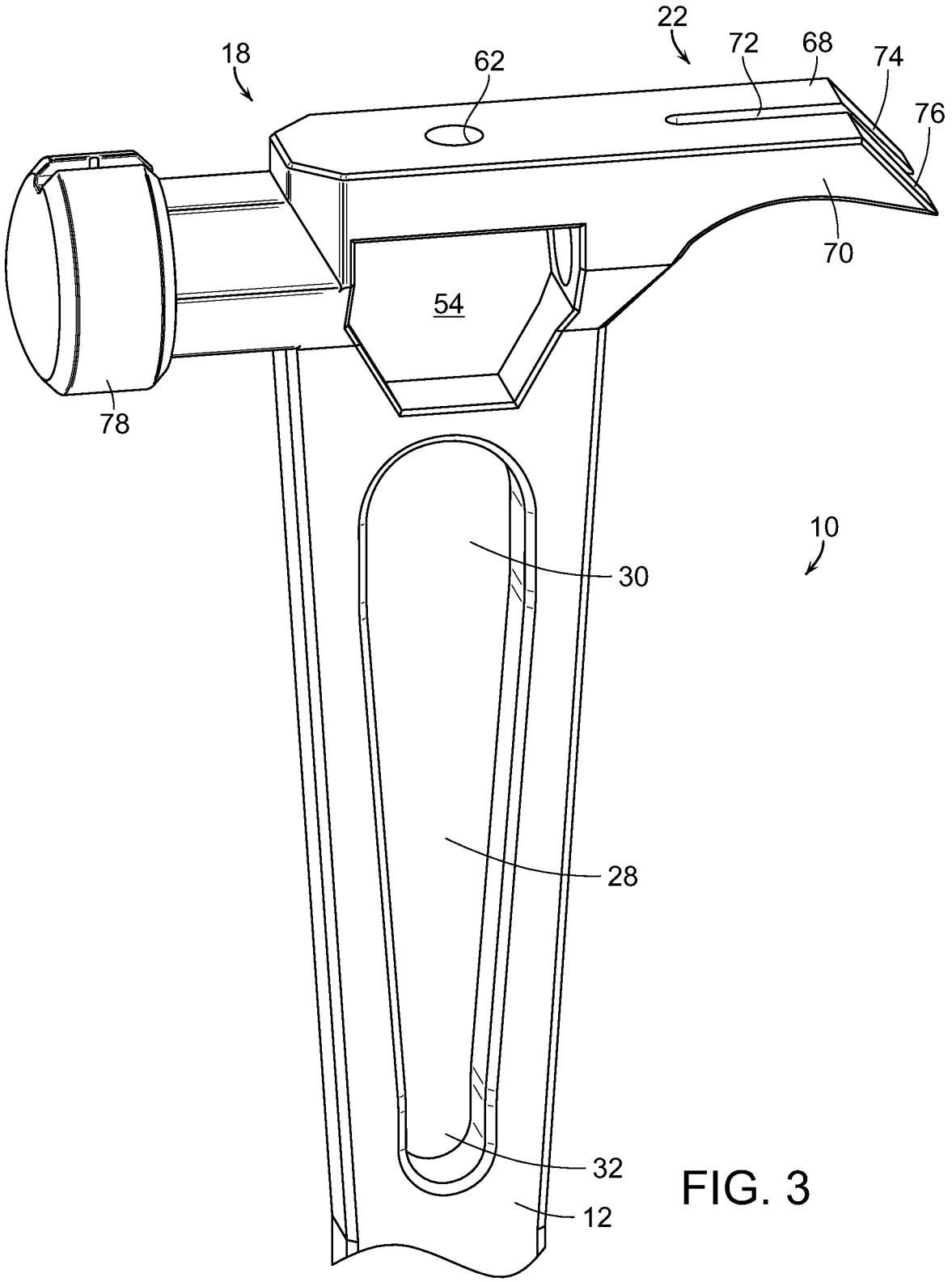
FIG. 3 is a partially fragmented and perspective view of a first end of a handle and head of the striking tool.

With reference to FIGS. 1 and 2, the striking tool 10 is generally comprised of an elongated handle 12 which has a first upper end 14 and a generally opposite second lower end 16. A head 18 is attached to the first end 14 of the handle 12, or as illustrated, is formed integrally therewith. The head 18 defines a striking portion 20, a claw portion 22, generally opposite the striking portion 20, and a body portion 24 disposed therebetween.

The striking tool 10 may be comprised of any suitable material, but in particularly preferred embodiments, the striking tool 10 is comprised of a titanium alloy which is lightweight and provides strength. The striking tool 10 may also be comprised of steel. It is also contemplated by the present invention that the handle 12 and head 18 be comprised of differing materials, or that component parts attachable to either the handle 12 or head 18 be comprised of different materials.

For example, the handle 12 is shown without a grip cover, although such a cover may be provided for the comfort of the user. Such a grip cover could comprise a sleeve or wrap comprised of leather, rubber or the like so as to enhance the gripability of the handle 12 and provide cushion to the user's hand. One or more openings or chambers 26 may be formed in the grip portion of the handle 12. These openings or chambers 26 could be formed in the handle 12 so as to lighten the overall weight of the striking tool 10, or could be filled with sand, pellets, polyurethane filling or the like before the handle 12 is wrapped, such as with a shrink wrap the sleeve or the like. Such fillings are intended to serve to mute vibrations to the handle 12 when the striking tool 10 strikes an object, thus lessening the vibrations to the user's hand and arm.

In one embodiment, the length of the handle 12, from the second end 16 thereof to the head 18, is sixteen inches. This length corresponds to commonly used distances in the construction industry, such as a typical distance between wall studs of a home or other building. Thus, either when framing such a house or building, or when attempting to find adjacent studs through a wall, the user of the striking tool 10 merely need to reference the length of the handle 12, eliminating the need to utilize a tape measure.

Figure 4:
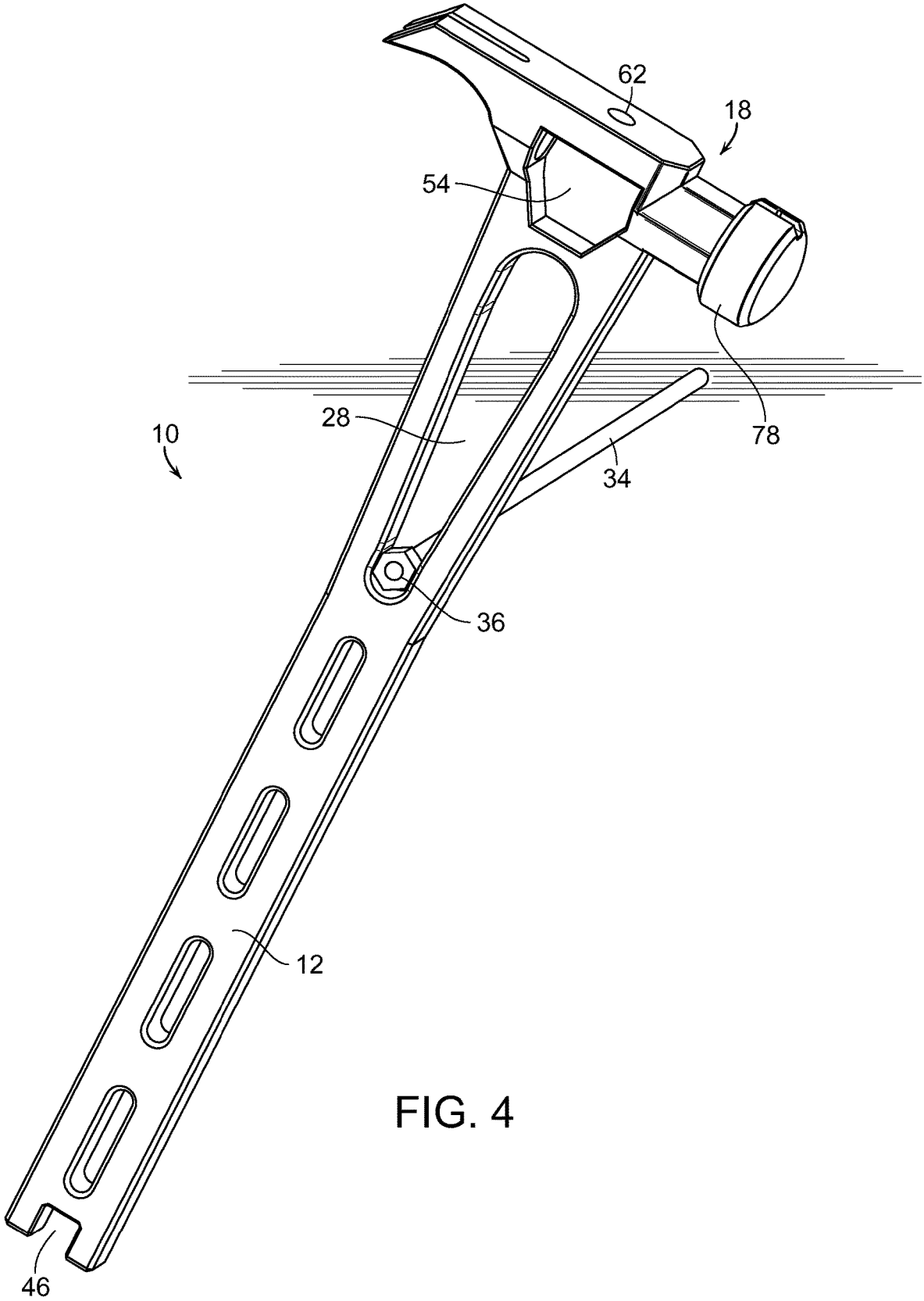
FIG. 4 is a perspective view illustrating a head of a fastener engaged with an end of an elongated slot of the handle of the striking tool, in accordance with the present invention.
Figure 5:
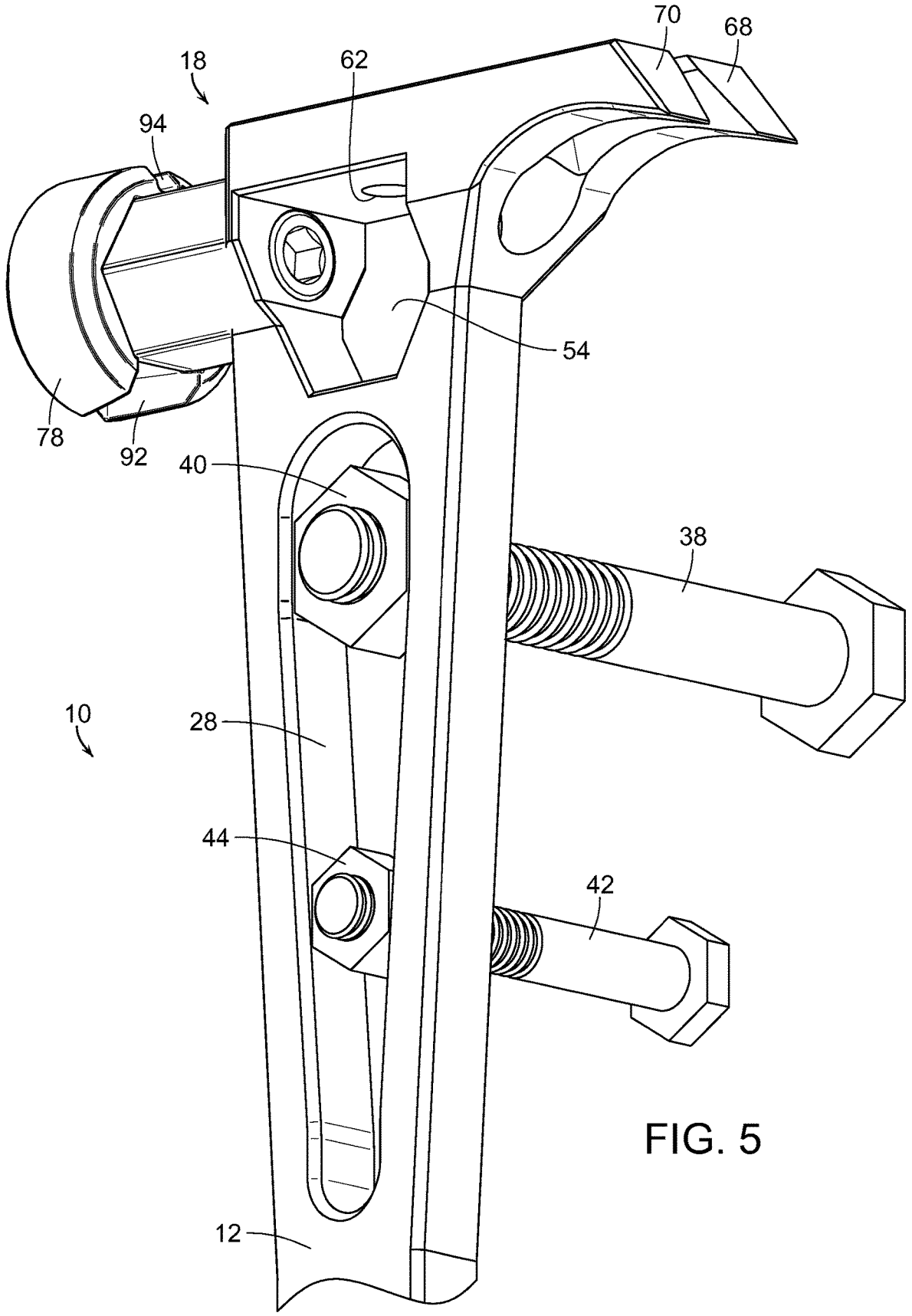
FIG. 5 is a partially fragmented perspective view illustrating fasteners of various size engaged between opposing walls of the elongated slot, illustrating the tapering of the elongated slot to engage fasteners or other objects of varying sizes in accordance with the present invention.

An elongated slot 28 is formed in the handle 12, above where would be disposed a grip. The slot 28 has a diameter sufficiently large between the internal walls thereof so as to engage a fastener or other object. In this manner, the fastener or other object can be inserted into the elongated slot 28 and the striking tool rotated so as to apply torsion thereto so as to loosen the fastener, rotate and/or remove the object from another object, such as a fastener from a wall or a nut from a bolt or the like. Preferably, the elongated slot 28 tapers along its length so as to be configured to engage fasteners or other objects of varying sizes, as illustrated in FIGS. 4 and 5. In the illustrated example, one end 30 of the slot 28 is enlarged with respect to the generally opposite second end 32 of the slot 28. By way of example, the first end 30 of the slot may have an internal diameter of approximately one inch, and the second end 32 of the slot 28 may have a diameter of approximately one-half inch, with the elongated slot 28 tapering along the length thereof between ends 30 and 32.

With reference to FIG. 4, a fastener 34 is shown having a head 36 thereof inserted into the elongated slot 28 near the smaller end 32 thereof. The fastener 34 could comprise a snap tie. Typically, such snap ties require the construction worker to use a wrench. However, utilizing the striking tool 10 of the present invention, the end 36 of the snap tie 34 could be inserted into the slot 28 until the outer surfaces of the head 36 are engaged with the inner surfaces of the slot 28, and the striking tool 10 rotated to apply torsion to the snap tie fastener 34 so as to snap and remove it. It will also be appreciated that the fastener 34 could comprise another object, such as an elongated bolt or the like having a nut attached at an end thereof, or having a multi-faceted head at an end thereof which could be engaged by the elongated slot 28 in the same manner described above.

With reference now to FIG. 5, a bolt 38 of a relatively large dimension is shown, having a nut 40 attached to an end thereof engaged within the elongated slot 28, at the first larger end 30 thereof. In this position, once the outer surface or facets of the nut 40 are engaged with the opposing side walls defining the slot 28, the striking tool 10 can be rotated so as to rotate and remove the nut 40 from the bolt 38. Similarly, a smaller bolt 42 having a smaller nut 44 attached to an end thereof is inserted within the elongated slot 28 until its outer surface engage the walls defining the slot 28, whereupon the striking tool 10 could be rotated to apply torsion thereto and loosen the nut 44 and remove it from the bolt 42. Thus, it will be appreciated that fasteners or objects of varying sizes can be selectively engaged and loosened, removed or the like using the slot 28 of the striking tool 10.

Figure 8:
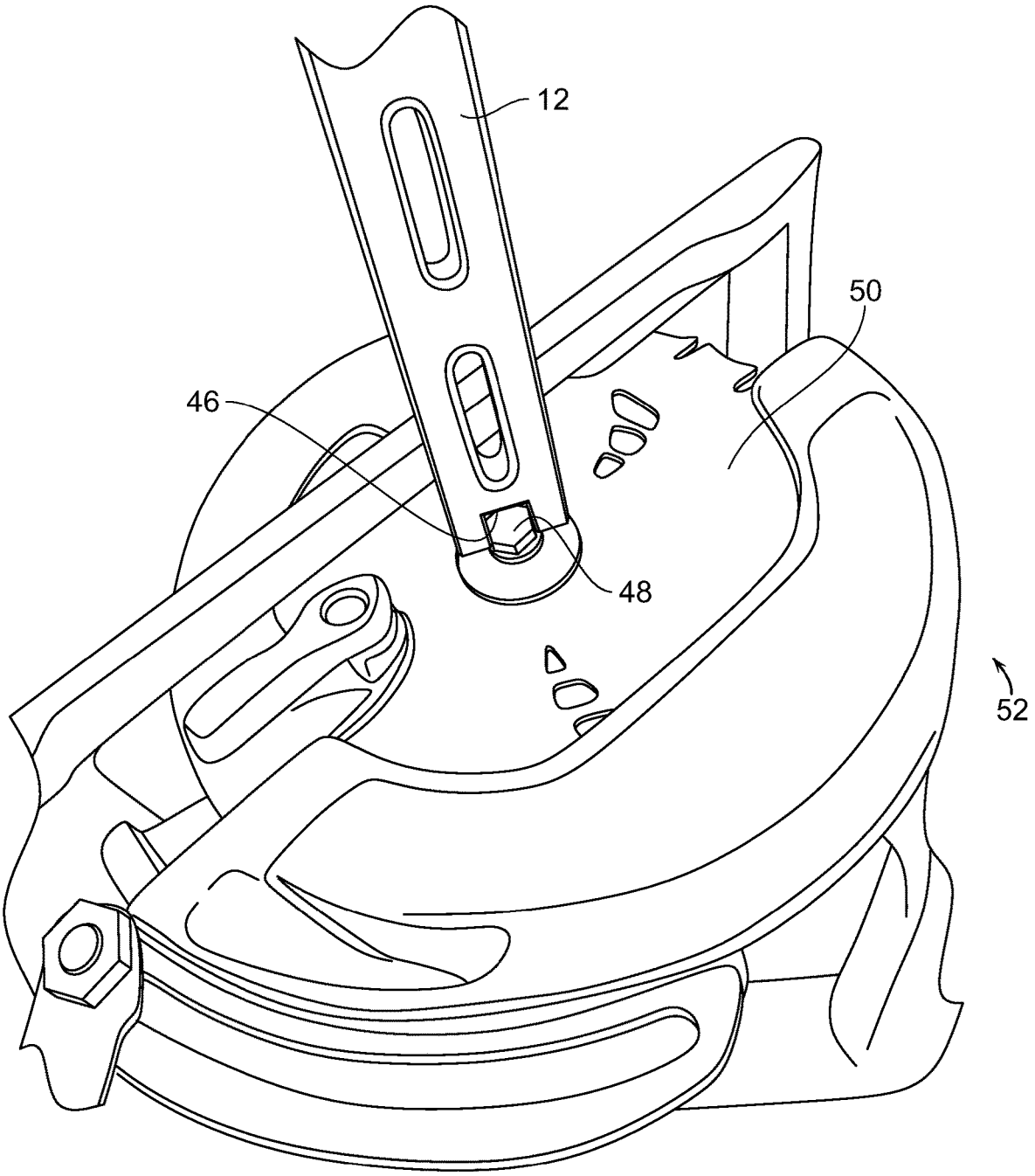
FIG. 8 is a perspective view of an open-ended notch at the second end of the handle of the tool engaging a fastener of a circular saw, in accordance with the present invention.
Figure 9:
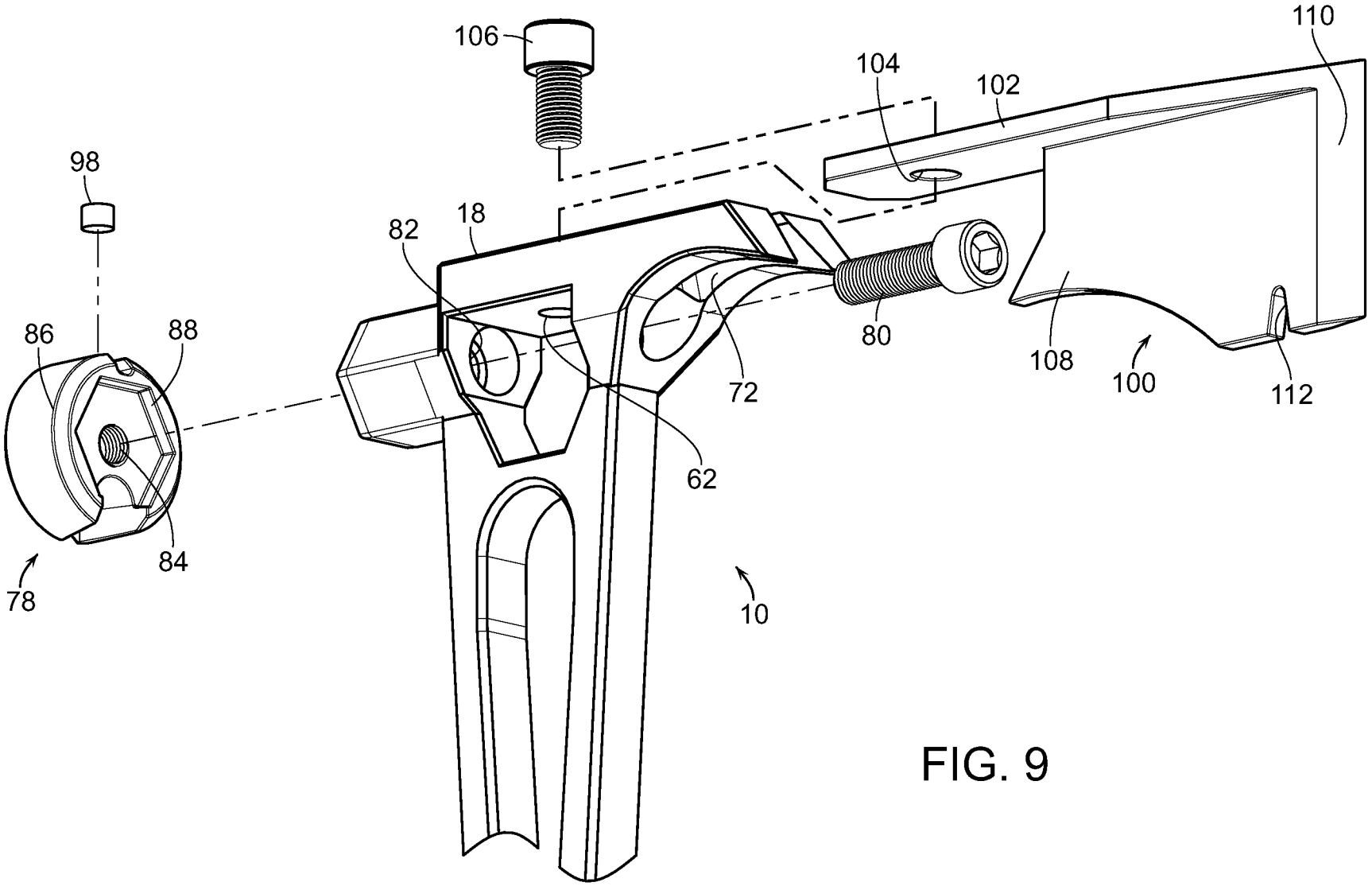
FIG. 9 is an exploded perspective view of component parts of the striking tool, including the attachment of an axe head thereto, in accordance with the present invention.

With reference now to FIGS. 1 and 8, an open-ended notch 46 is formed at the second end 16 of the handle 12. The open-ended notch 46 is sized and configured for engaging a fastener or other object. As illustrated in FIG. 8, the open-ended notch 46 is sized and configured, in a particularly preferred embodiment, to engage a fastener 48 of a blade 50 of a circular saw 52. In such cases, typically, the fastener 48 is one-half inch in diameter, and thus the open-ended slot 46 would also be approximately one-half inch in diameter so as to operably engage the outer surface and opposing facets of the fastener 48 so as to enable the striking tool 10 to be rotated and loosen and remove the fastener 48, and thus the blade 50 from the circular saw or skill saw 52. Thus, the open-ended notch 46 enables the construction worker or other user to remove and change the blade 50 of a circular saw 52 without the need of the use of a separate wrench, which provides convenience and saving of time to the construction worker or user.

Figure 6:
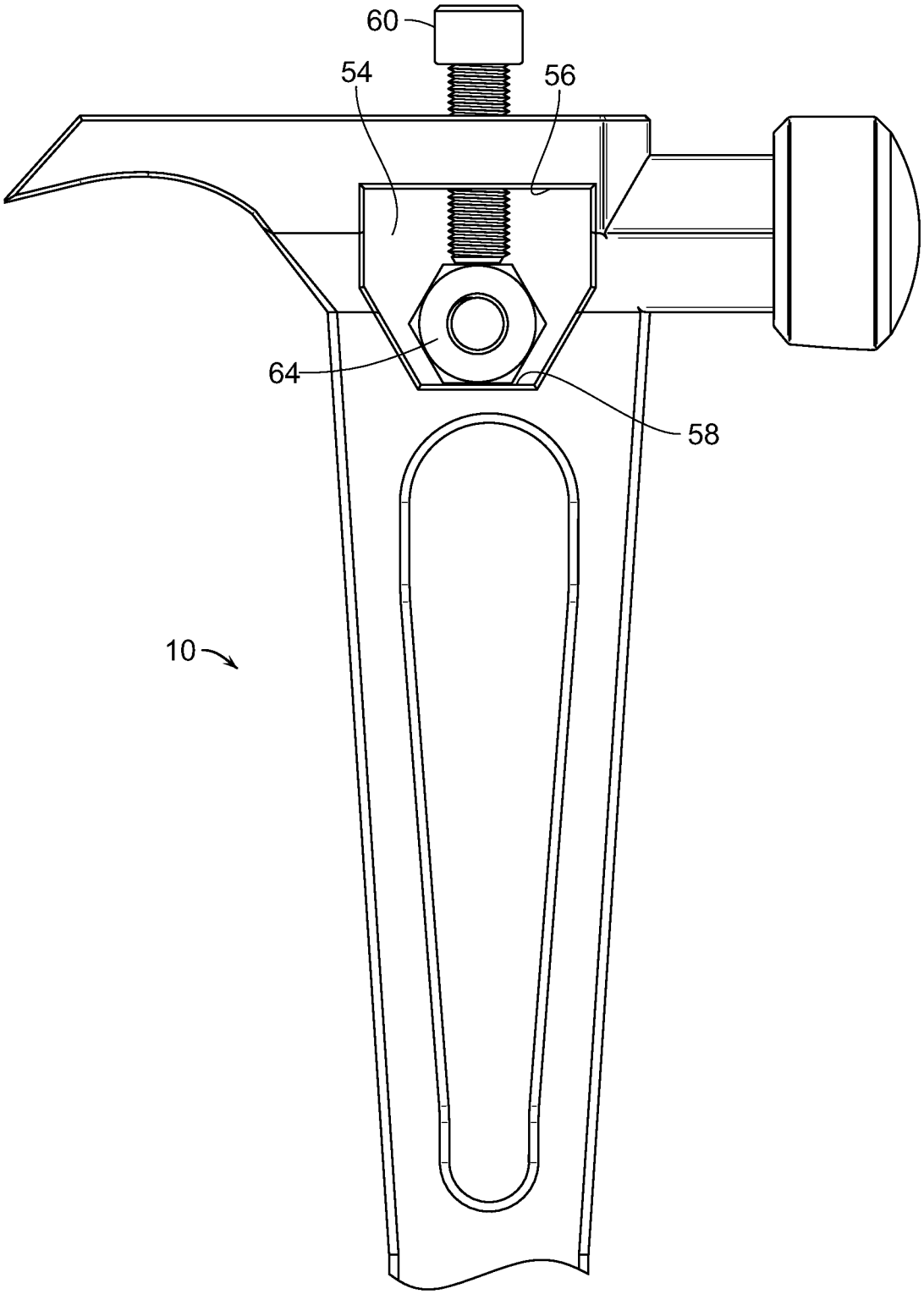
FIG. 6 is a side view of the striking tool, illustrating a fastener disposed within an open-faced cavity of the head and a bolt extending into the cavity to engage the fastener, in accordance with the present invention.
Figure 7:
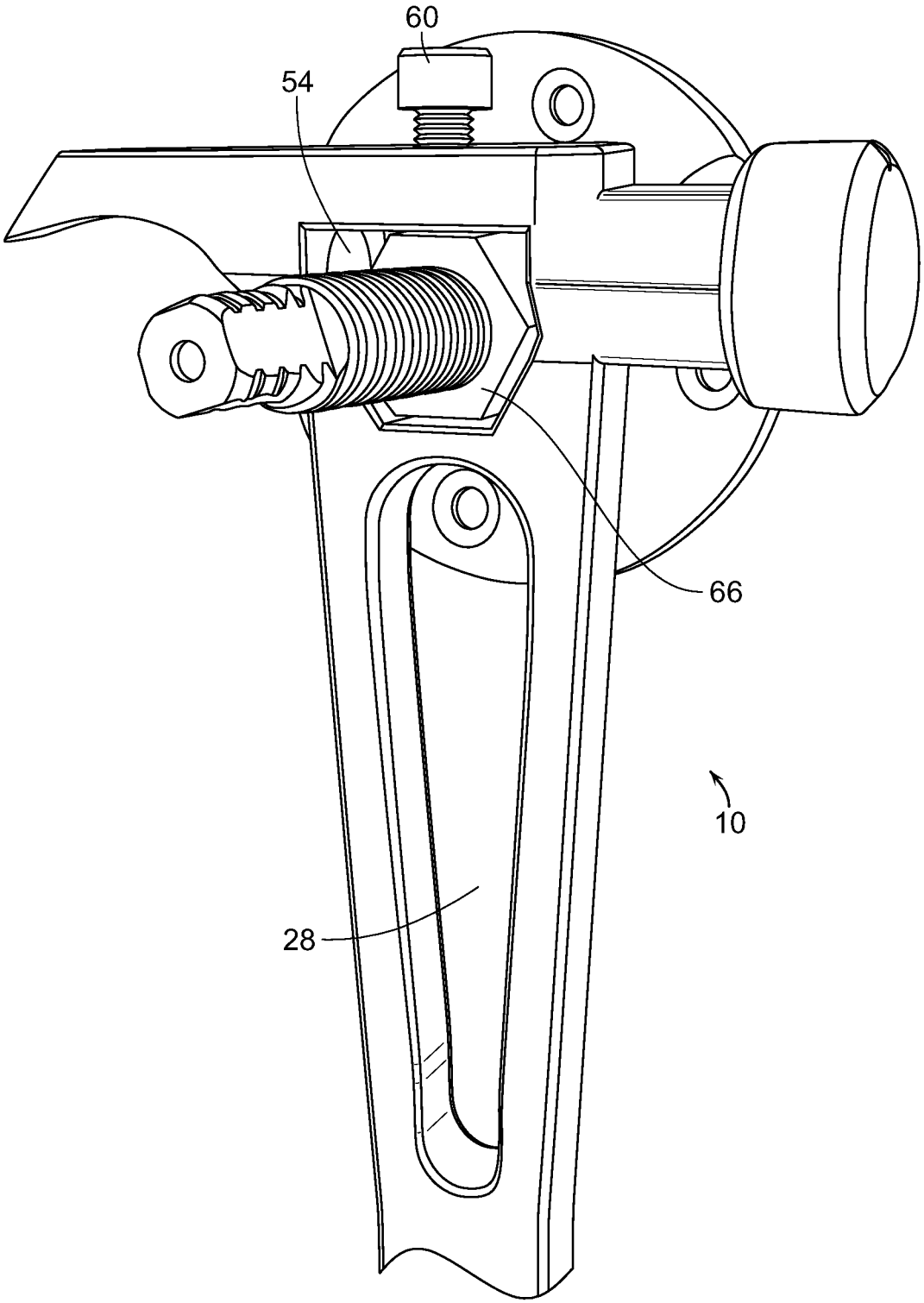
FIG. 7 is a side perspective view illustrating a larger fastener disposed within the open-faced cavity, in accordance with the present invention.

With reference to FIGS. 1-7, an open-faced cavity 54 is formed in the body portion 24 of the head 18 for engaging a fastener or other object. As illustrated, the cavity may extend completely through opposite sides of the body portion 24 of the head 18 such that a fastener or other object can be inserted into either side of the cavity, or even extend through the cavity 54, as illustrated in FIG. 7. As illustrated, the cavity 54 may also extend, and be defined at least partially by, the upper end 14 of the handle 12. The cavity 54 is preferably defined by a plurality of walls, such that the cavity 54 is multi-faceted. In the illustrated exemplary embodiments, the open-faced cavity 54 is of a generally hex configuration. The open-faced cavity 54 may also have varying dimensions, such as in the illustrations and upper wall 56 thereof being elongated with respect to a generally opposite lower wall 58. By way of example, the upper wall 56 may have a length of 1.5 inches, whereas the lower wall 58 may have a length of 1.0 inches. Such a configuration may enable the cavity 54 to engage fasteners or other objects of varying sizes.

In order to adjustably engage fasteners or objects of varying sizes, an adjustment mechanism may be associated with the cavity 54. The adjustment mechanism securely retains the fastener or other object within the cavity 54, such that torsion or other tension force could be applied to the fastener or object so as to loosen, remove, or break the fastener or object. In an embodiment, as illustrated, the adjustment member comprises a bolt 60 which is selectively threadedly received through in internally threaded aperture 62 of the head 18. A fastener 64, such as illustrated in FIG. 6, which may comprise a nut, other fastener or object, is disposed within the cavity 54. The bolt 60 is increasingly threadedly received through the head 24 until it securely engages the fastener or object 64. The striking tool 10 can then be rotated so as to loosen, remove, break, or the like the fastener or object 64.

With reference to FIG. 7, a larger fastener 66 is shown inserted into the cavity 54. In such case, the bolt 60 may not need to be threaded into the cavity 54 to the same degree as a smaller fastener, such as illustrated in FIG. 6, or may not be necessary at all depending upon the size of the object or fastener 66 if the outer surfaces of the object or fastener 66 engage multiple walls or facets of the cavity 54.

The adjustment bolt 60 enables objects and fasteners of varying sizes to be inserted into the cavity 54 and tightened, loosened, removed, broken, or the like. Such could be used, for example, when removing she-bolts which are ties for medium and heavy concrete construction. Instead of needing to acquire and use a wrench, the she-bolt fastener can merely be inserted into the cavity, the adjustment bolt 60 adjusted as necessary, and then the striking tool 10 rotated to break the tension off of the she-bolt and slowly twist it out and remove it. Of course, other fasteners and objects could be tightened, loosened, removed, broken, etc. as needed and as can be accommodated by the cavity 54 and the adjustment bolt 60.

With particular reference now to FIGS. 3-6, the striking tool 10 comprises a claw portion 22 at one end of the head 18. The claw portion 22 comprises generally parallel claw members 68 and 70 which are separated by a gap 72 which forms a nail puller. Preferably, the gap 72 is sufficiently large so as to be able to remove relatively large nails, such as a 16*d* or a 20*d* or even a 40*d* which are fairly large in diameter. Accordingly, the gap 72 may be a quarter inch in diameter between the claw members 68 and 70 to accommodate these larger nails. The gap 72 may be generally uniform, as illustrated, or diverge towards the open end thereof, so as to accommodate nails of varying thicknesses and sizes.

In the prior art, the claw portion of a hammer head has such as nail-pulling slot or gap, but the claw members typically extend from having a thickness of approximately a half an inch down to an eighth of an inch, and the claw members are elongated and curved. A disadvantage of such an arrangement is that when a large amount of pressure is applied to the claws, they may bend or break. Accordingly, the claw portion 22 of the head 18, and particularly the claw members 68 and 70, are of a thickness or width so as to resist bending or breaking. When the head 18 is comprised of a titanium alloy, which may be several times stronger than steel, a thicker half-inch profile of the claw members 68 and 70, along a length thereof, resist such bending and breaking and would be the equivalent of an inch and a half thickness of steel claw, which is not in existence.

Another difference in the claw members 68 and 70 as compared to prior art claw members, which typically form an arc along the length thereof to a relatively thin outer edge, is that the claw members 68 and 70 of the present invention have ends 74 and 76 which are formed at an acute angle with respect to the generally planar surface of the head 18. This enables the claw portion 22 to serve more as a crowbar or prybar when removing nails or other objects. The flat faces of the ends 74 and 76 of the claw members 68 and 70 can be placed upon the working surface, with the nail or other object inserted into the gap 72. The striking tool 10 can then be rotated, and the junction between the angled end 74 and 76 and the remainder of the claw members 68 and 70 act as a fulcrum for applying leverage to remove the nail or other object. This can be done as a regular pull, a side pull, a head pull or the like, and regardless of the direction of the torsion applied thereto, the configuration and thickness of the claw members 68 and 70 resist deformation and breakage even when a large amount of force is applied thereto. When the claw members 68 and 70 are forcibly inserted into an object, such as drywall or another such object, removal of the claw portion 22 from the object is also facilitated due to the configuration illustrated and described above.

With particular reference now to FIG. 2, a striking member 78 may be removably attached to the striking portion 20 of the head 18 of the striking tool 10. In prior art hammers, the striking face or striking member of the striking tool or hammer can become deformed and damaged over time. However, the entire hammer or striking tool must be replaced when this occurs. In the present invention, the striking member 78 is removably attached to the head 18 such that if it is damaged it can be replaced without replacing the entire striking tool 10. Moreover, the striking member 78 may be comprised of a different material than the head 18 or other portions of the striking tool 10. For example, the striking member 78 may be comprised of a hardened steel or other hard material which would resist damage. Alternatively, the striking member 78 could be comprised of a softer or more flexible material, if desired.

Figure 12:
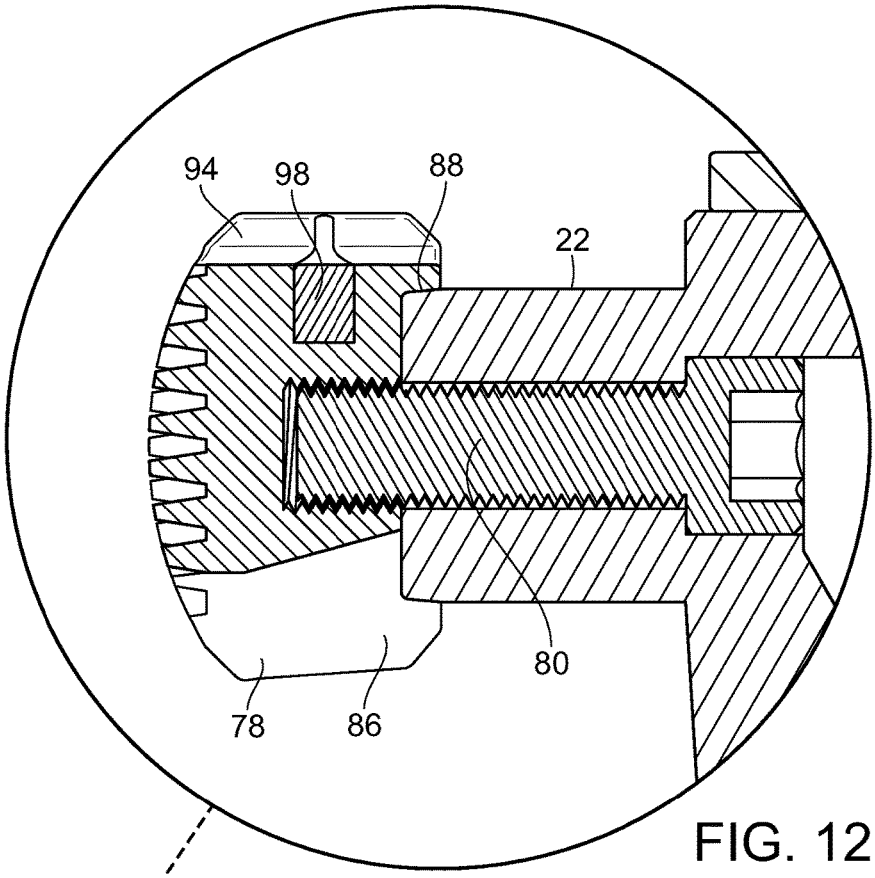
FIG. 12 is an enlarged view of area "12" of FIG. 11, illustrating the attachment of a striking member to a striking portion of the head of the striking tool, in accordance with the present invention.
Figure 11:
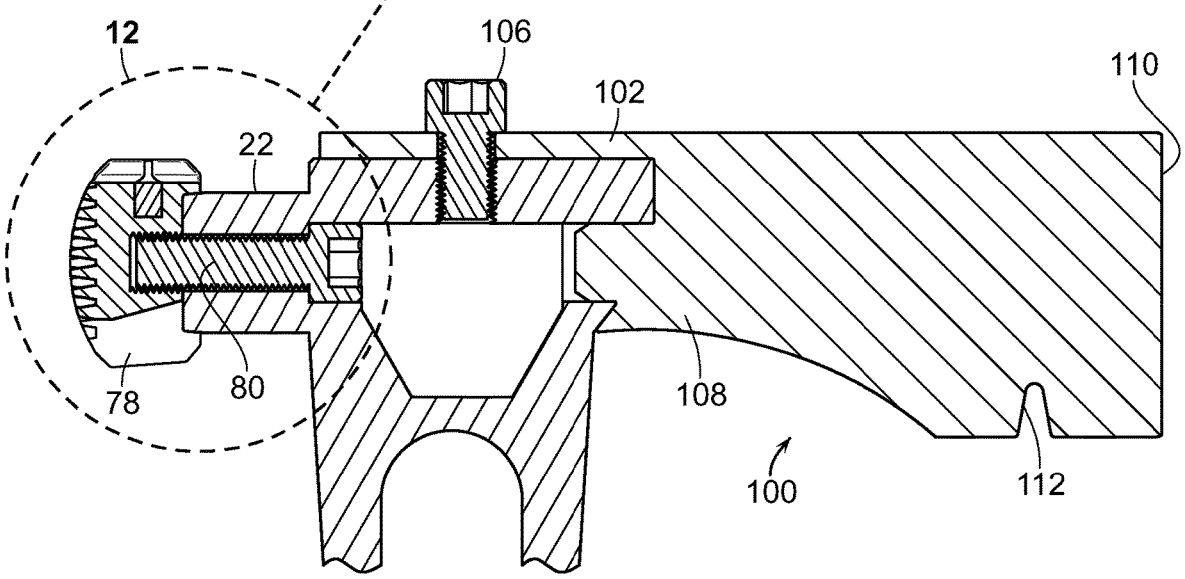
FIG. 11 is a cross-sectional view taken generally along lines 11-11 of FIG. 10.

In order to attach the striking member 78 to the striking portions 20 of the head 18, a fastener 80, such as the illustrated threaded bolt, is inserted through a passageway 82 of the head 18 and into a threaded aperture or recess 84. The attachment of the striking member 78 to the striking portion 22 of the head is shown in FIGS. 11 and 12. As the bolt 80 or other fastener is increasingly threadedly received into the internally threaded aperture 84 of the striking member 78, the striking member is brought into contact with the striking portion 22 of the head 18. The striking member 78 includes an apron 86 or wall which forms a cavity into which at least a portion of the striking portion 22 of the head 18 enters. Preferably, there is a beveled inner surface 88, or ribbon or the like, which frictionally engages an outer surface of the striking portion 22 of the head 18 as the striking member 78 is fastened to the striking portion 22 of the head 18. In this manner, a positive and very secure connection is made between the striking member 78 and the striking portion 22 of the head 18. Moreover, this reduces or even eliminates the possibility that the striking member 78 will move or rotate when in use.

Figure 13:
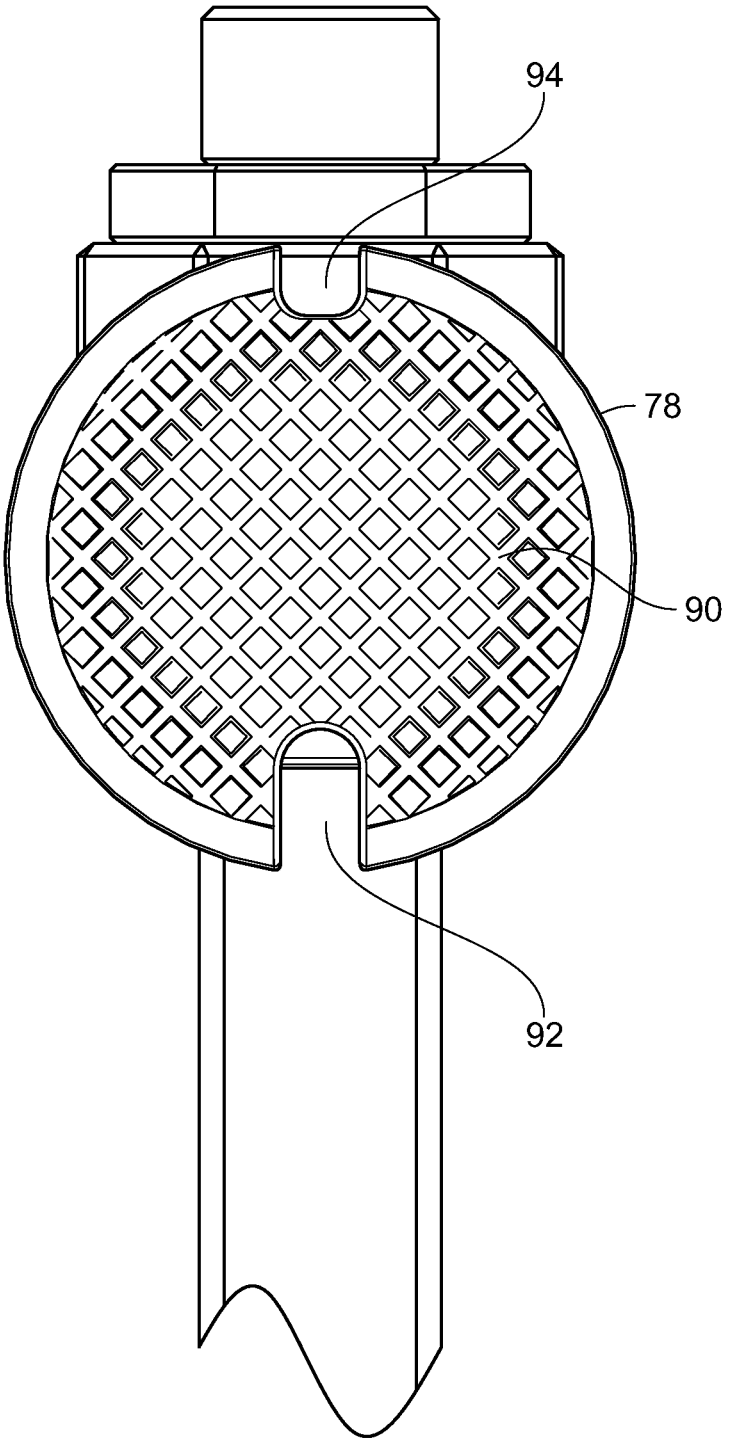
FIG. 13 is an end view of the striking tool having the striking member attached thereto.
Figure 14:
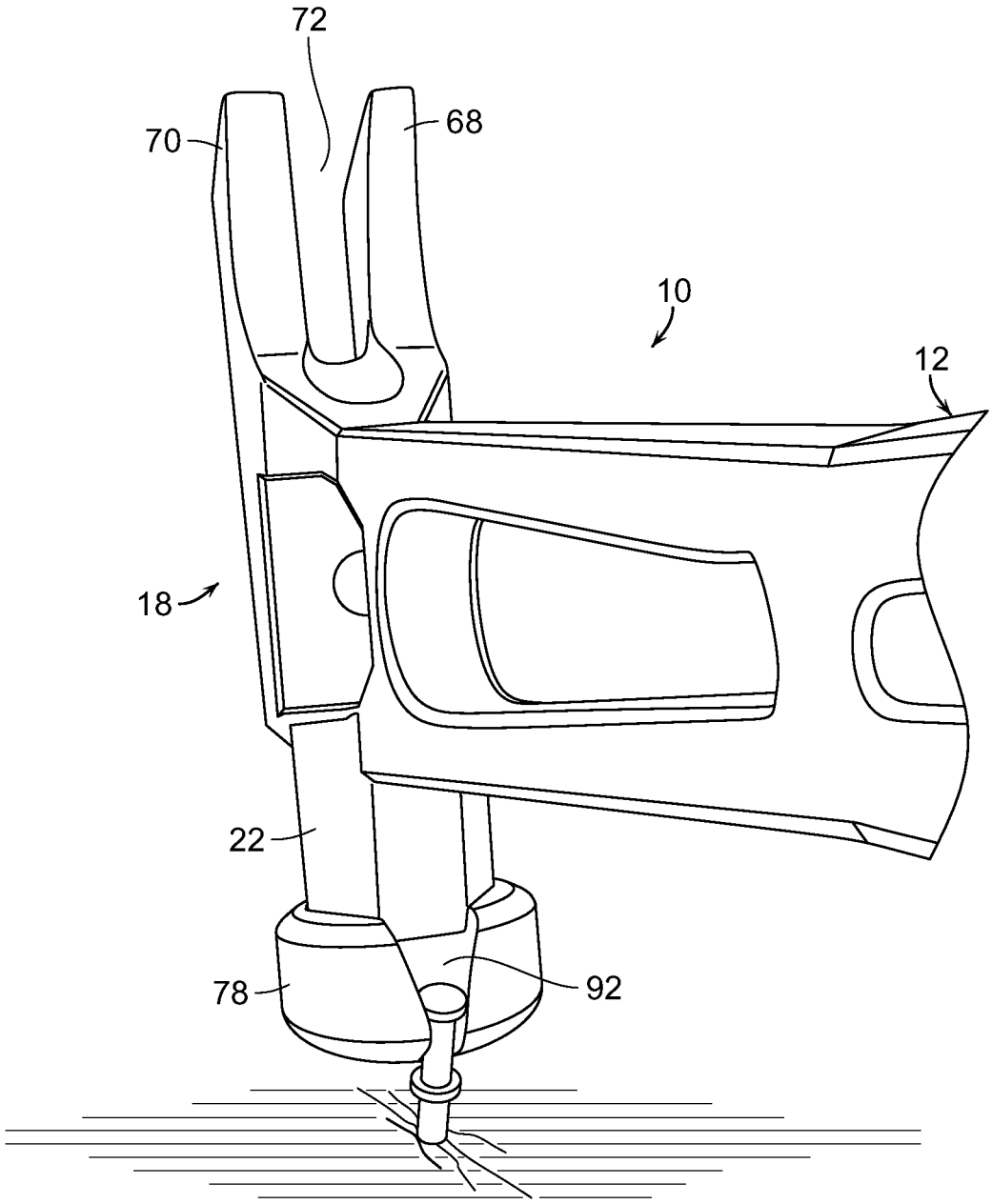
FIG. 14 is a perspective view illustrating removal of a nail, using a nail puller of the striking member, in accordance with the present invention.
Figure 15:
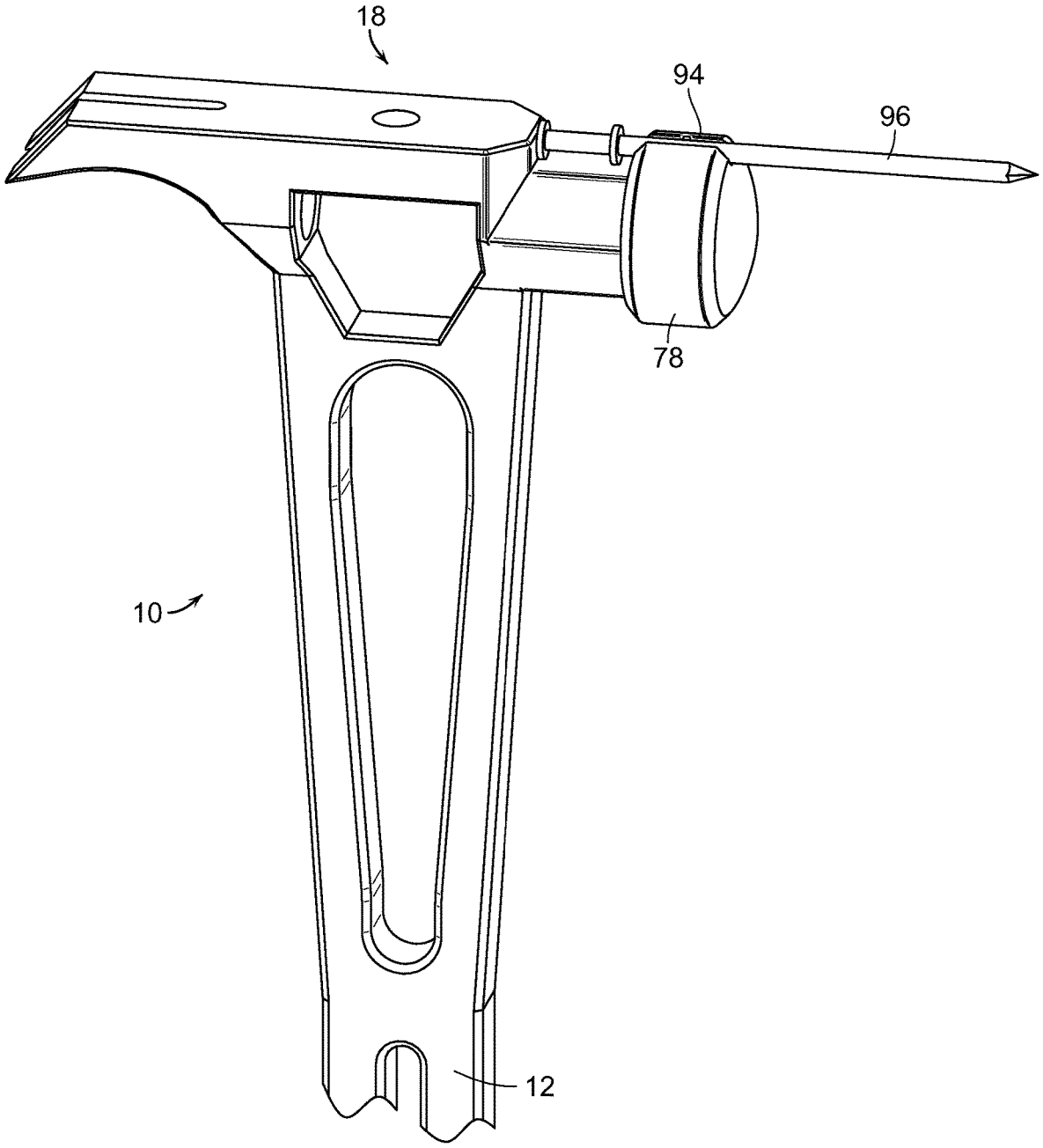
FIG. 15 is a perspective view illustrating a nail disposed within a setting groove of the striking member, in accordance with the present invention.

With reference now to FIGS. 13-15, a face 90 of the striking member 78 may have a smooth or a patterned face, such as the illustrated waffle pattern face. Such a pattern face 90 can increase the friction when the striking member 78 strikes an object, such as a nail or the like, such that there is a more efficient transfer of energy thereto, while reducing slippage.

The striking member 78 may include a notch 92 formed therein having opposing edges which define a nail puller. As illustrated in FIG. 14, such edges may taper or diverge from one another to accommodate different sized nail heads or other objects therein to be removed by the nail puller 92. Having a nail puller 92 formed in the striking head 78 can provide convenience to the user of the striking tool 10. For example, when one needs to pull nails out of a wall, the striking member 78 can simply be brought down over the nail head, and then the striking tool 10 pivoted and rotated so as to pull the nail out of the wall or other object.

With reference now to FIGS. 13 and 15, the striking member 78 may also include a nail setting slot 94, typically on an upper surface thereof, which may be generally opposite the nail puller 92. A nail 96 may be inserted into the slot 94 so that it can be tapped into a wall or other object as a preliminary step before applying a large amount of force through the striking member 78. The nail can be held in place due to the size of the slot 94 and/or due to a magnet 98 embedded within the striking member 78 adjacent to the slot 94 so as to hold the metal nail or other fastener 96 within the slot 94. By inserting a nail 96 into the slot 94 and slightly tapping it against a wall or other object, it can be set into position, and thereafter the full force of the striking member 78, by swinging the striking tool 10, can be applied to the nail or other fastener to drive it fully into the wall or object.

Figure 10:
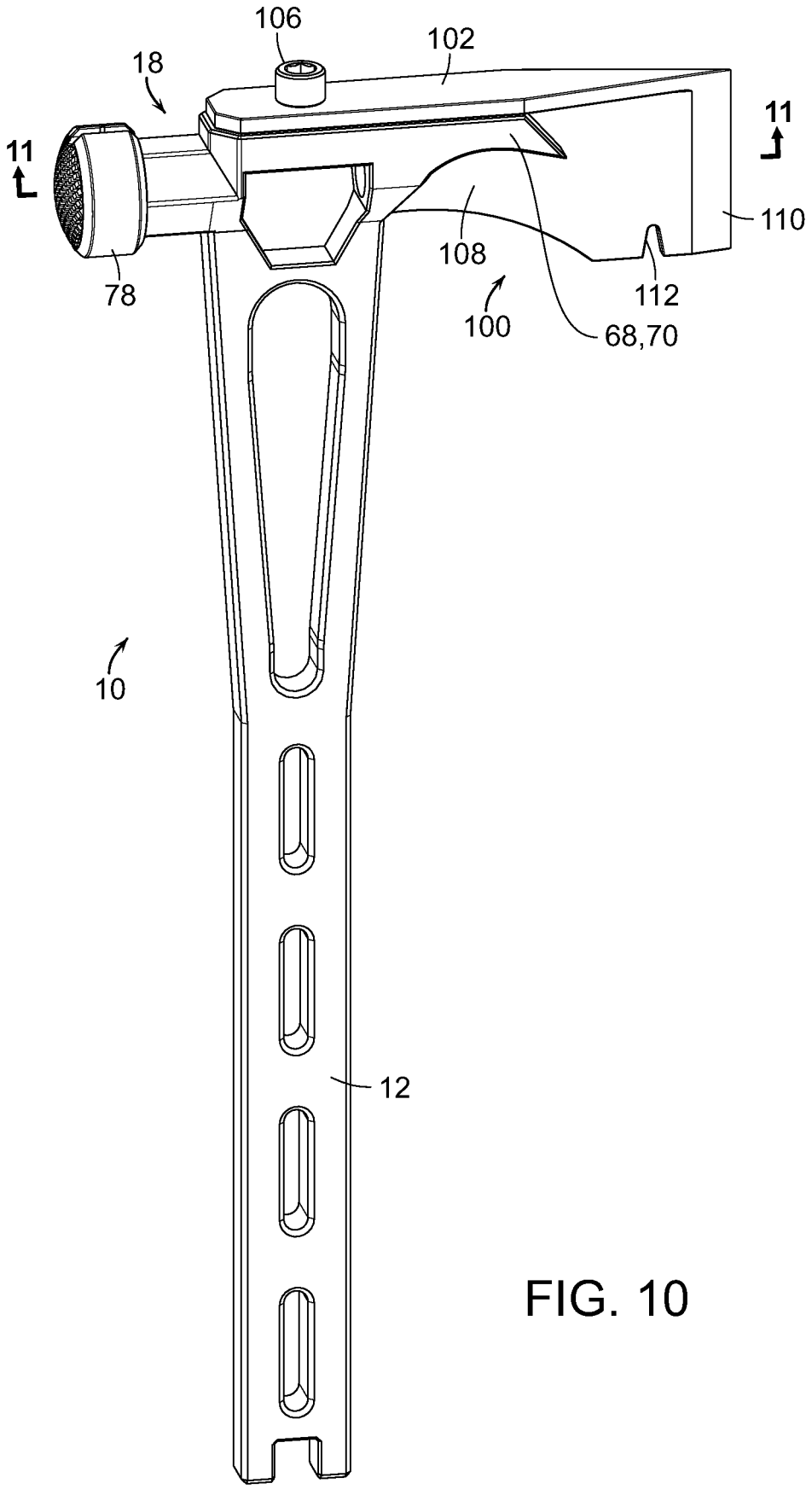
FIG. 10 is a side perspective view of the striking tool having the attached axe head.

With reference now to FIGS. 10-11, attachments may be removably attached to the striking tool 10 in order to perform other functions. For example, as illustrated, an axe head 100 may be removably attachable to the head 18 of the striking tool 10. This would enable the striking tool 10 to cut or chop objects. This could be particularly useful, for example, by a lather or a drywall framer who need such an axe or cutting portion of a striking tool.

In the illustrated case of an axe head 100, the axe head 100 includes a platform portion 102 which is slidable over the top planar surface of the head 18 of the striking tool 10. The platform is inserted onto the head 18 until aperture 104 of the platform 102 is aligned with aperture 62 such that a bolt or other fastener 106 can be threadedly inserted therethrough so as to fasten the axe head 100 to the head 18 of the striking tool 10. The bolt 106 may be the same as the adjusting bolt 60, or may be a bolt of having a shorter shank so as to merely fasten the axe head 100 to the head 18 and not extend excessively into cavity 54.

The axe head 100 may also include a tongue portion 108 which extends into the gap 72 of the claw portion 20, between the claw members 68 and 70 as the platform 102 is disposed over the planar portion of the head 18. This serves to further secure the axe head 100 to the head 18 of the striking tool 10, and prevent rotation, pivoting or other movement of the axe head 100 once it is attached to the head 18.

The axe head 100 includes an outer blade 110 for cutting objects. A notch 112 may also be formed in the blade portion so as to remove nails or other objects, as needed or desired.

Although an axe head 100 has been illustrated and described as being an attachment, it will be appreciated that other attachments could be attached to the striking tool 10 as desired or needed.

Although several embodiments have been described in detail for purposes of illustration, various modifications may be made without departing from the scope and spirit of the invention. Accordingly, the invention is not to be limited, except as by the appended claims.

What is claimed is:

1. A striking tool, comprising:

an elongated handle having a first end and a second end;

a head attached to or formed integrally with the first end of the handle and defining a striking portion, a claw portion generally opposite the striking portion and a body portion therebetween;

an open-faced cavity formed in the body portion of the head for engaging fasteners or other objects;

an elongated slot formed in the handle, the slot having a tapering diameter along a length thereof and defined by opposing walls configured to engage the fasteners or the other objects for applying torsion thereto; and a striking member removably attached to the striking portion of the head, wherein the striking member comprises a striking face and an apron extending therefrom and defining a beveled inner surface that frictionally engages a surface of the striking portion of the head as the striking member is fastened to the striking portion of the head.

2. The striking tool of claim 1, including an open-ended notch formed at the second end of the handle for engaging the fasteners or the other objects.

3. The striking tool of claim 1, including an adjustment mechanism associated with the cavity, including a member extendable into the cavity, that adjustably engages the fasteners or the other objects.

4. The striking tool of claim 3, wherein the adjustment mechanism comprises a bolt selectively threadedly received through the head and into the cavity.

5. The striking tool of claim 1, including an attaching fastener extending through a passageway of the head and into an aperture of the striking member.

6. The striking tool of claim 1, wherein the striking member includes a notch formed therein having opposing edges which define a nail puller.

7. A striking tool, comprising:

an elongated handle having a first end and a second end;

a head attached to or formed integrally with the first end of the handle and defining a striking portion, a claw portion having a pair of claw members separated by a gap, generally opposite the striking portion, and a body portion therebetween;

an open-faced cavity formed in the body portion of the head for engaging fasteners or other objects;

an elongated slot formed in the handle, the slot having a tapering diameter along a length thereof and defined by opposing walls configured to engage the fasteners or the other objects for applying torsion thereto; and an axe head removably attachable to the head of the striking tool so as to extend from the claw portion.

8. A striking tool, comprising:

an elongated handle having a first end and a second end;

a head attached to or formed integrally with the first end of the handle and defining a striking portion, a claw portion generally opposite the striking portion and a body portion therebetween;

an open-faced cavity formed in the body portion of the head for engaging fastener or other objects;

an adjustment mechanism associated with the cavity, including a member extendable into the cavity, that adjustably engages the fastener or the other objects; and a striking member removably attached to the striking portion of the head, wherein the striking member comprises a striking face and an apron extending therefrom and defining a beveled inner surface that frictionally engages a surface of the striking portion of the head as the striking member is fastened to the striking portion of the head.

9. The striking tool of claim 8, wherein the adjustment mechanism comprises a bolt selectively threadedly received through the head and into the cavity.

10. The striking tool of claim 8, including an open-ended notch formed at the second end of the handle for engaging the fasteners or the other objects.

11. The striking tool of claim 8, including an elongated slot formed in the handle, the slot having a tapering diameter along a length thereof and defined by opposing walls configured to engage the fastener or the other objects for applying torsion thereto.

12. The striking tool of claim 8, including an attaching fastener extending through a passageway of the head and into an aperture of the striking member.

13. The striking tool of claim 8, wherein the striking member includes a notch formed therein having opposing edges which define a nail puller.

14. A striking tool, comprising:

an elongated handle having a first end and a second end;

a head attached to or formed integrally with the first end of the handle and defining a striking portion, a claw portion having a pair of claw members separated by a gap, generally opposite the striking portion and a body portion therebetween;

an open-faced cavity formed in the body portion of the head for engaging a fastener or the other objects, and an adjustment mechanism associated with the cavity, including a member extendable into the cavity, that adjustably engages the fastener or the other objects; and an axe head removably attachable to the head of the striking tool so as to extend from the claw portion.

15. A striking tool, comprising:

an elongated handle having a first end and a second end;

a head attached to or formed integrally with the first end of the handle and defining a striking portion, a claw portion generally opposite the striking portion and a body portion therebetween;

a striking member removably attached to the striking portion of the head;

a notch formed in the striking member having opposing edges which define a nail puller; and wherein the striking member comprises a striking face and an apron extending therefrom and defining a beveled inner surface that frictionally engages a surface of the striking portion of the head as the striking member is fastened to the striking portion of the head.

16. The striking tool of claim 15, including a fastener extending through a passageway of the head and into an aperture of the striking member.

17. The striking tool of claim 15, including an open-ended notch formed at the second end of the handle for engaging a fastener.

18. The striking tool of claim 15, including an open-faced cavity formed in the body portion of the head for engaging a fastener or other objects.

19. The striking tool of claim 18, including an adjustment mechanism associated with the cavity, including a member extendable into the cavity, that adjustably engages the fastener or the other objects.

20. The striking tool of claim 19, wherein the adjustment mechanism comprises a bolt selectively threadedly received through the head and into the cavity.

21. The striking tool of claim 15, including an elongated slot formed in the handle, the slot having a tapering diameter along a length thereof and defined by opposing walls configured to engage fasteners or other objects of varying sizes for applying torsion thereto.

22. A striking tool, comprising:

an elongated handle having a first end and a second end;

a head attached to or formed integrally with the first end of the handle and defining a striking portion, a claw portion generally opposite the striking portion and a body portion therebetween;

a striking member removably attached to the striking portion of the head;

a notch formed in the striking member having opposing edges which define a nail puller;

an open-faced cavity formed in the body portion of the head for engaging a fastener or other object;

an adjustment mechanism associated with the cavity, including a member extendable into the cavity, that adjustably engages the fastener or the other object; and and an axe head removably attachable to the head of the striking tool so as to extend from the claw portion.

23. A striking tool, comprising:

an elongated handle having a first end and a second end;

a head attached to or formed integrally with the first end of the handle and defining a striking portion, a claw portion generally opposite the striking portion and a body portion therebetween;

an elongated slot formed in the handle, the slot having a tapering diameter along a length thereof and defined by opposing walls configured to engage fasteners or other objects for applying torsion thereto; and a striking member removably attached to the striking portion of the head, wherein the striking member comprises a striking face and an apron extending therefrom and defining a beveled inner surface that frictionally engages a surface of the striking portion of the head as the striking member is fastened to the striking portion of the head.

24. A striking tool, comprising:

an elongated handle having a first end and a second end;

a head attached to or formed integrally with the first end of the handle and defining a striking portion, a claw portion generally opposite the striking portion and a body portion therebetween;

an open-faced cavity formed in the body portion of the head for engaging fasteners or other objects;

an adjustment mechanism associated with the cavity for adjustably engaging the fasteners or the other objects; and a striking member removably attached to the striking portion of the head, wherein the striking member comprises a striking face and an apron extending therefrom and defining a beveled inner surface that frictionally engages a surface of the striking portion of the head as the striking member is fastened to the striking portion of the head.

* * * * *